US010612230B2

(12) United States Patent
Hsu

(10) Patent No.: US 10,612,230 B2
(45) Date of Patent: Apr. 7, 2020

(54) CABLE CONTROL DEVICE FOR PIPELINE CLEANER

(71) Applicant: SDY International Co., Ltd., Taichung (TW)

(72) Inventor: Wei-Tien Hsu, Taichung (TW)

(73) Assignee: SDY International Co., Ltd., Taichung (TW)

( * ) Notice: Subject to any disclaimer, the term of this patent is extended or adjusted under 35 U.S.C. 154(b) by 98 days.

(21) Appl. No.: 16/021,117

(22) Filed: Jun. 28, 2018

(65) Prior Publication Data

US 2020/0002931 A1 Jan. 2, 2020

(51) Int. Cl.
*E03F 9/00* (2006.01)
*B08B 9/04* (2006.01)

(52) U.S. Cl.
CPC ..... *E03F 9/005* (2013.01)

(58) Field of Classification Search
CPC ..... E03F 9/005; B08B 9/04; B08B 9/045
USPC ..... 15/104.33
See application file for complete search history.

(56) References Cited

U.S. PATENT DOCUMENTS 5,029,356 A * 7/1991 Silverman ..... E03F 9/005 15/104.33
5,640,736 A * 6/1997 Salecker ..... B08B 9/045 15/104.31
5,901,401 A * 5/1999 Rutkowski ..... E03F 9/005 15/104.31
6,158,076 A * 12/2000 Rutkowski ..... E03F 9/005 15/104.31
6,615,436 B1 * 9/2003 Burch, Jr. ..... B08B 9/045 15/104.05
2004/0255415 A1 * 12/2004 Silva ..... B08B 9/045 15/104.33
2016/0175899 A1 * 6/2016 Dunkin ..... B08B 9/04 15/104.33
2017/0304879 A1 * 10/2017 Hsu ..... B08B 9/04

FOREIGN PATENT DOCUMENTS

EP 2277634 A1 1/2011
EP 3059022 A1 8/2016

* cited by examiner

*Primary Examiner* — Weilun Lo
(74) *Attorney, Agent, or Firm* — Alan D. Kamrath; Mayer & Williams PC

(57) ABSTRACT

A cable control device for a pipeline cleaner includes a barrel, a control member and a toggle. The pipeline cleaner includes a support tube and a cable accommodated in a cable drum. The barrel mounted at the front end of the support tube is provided with an adapter thereon. The barrel accommodates first and second rollers in a lower portion thereof. The control member rotationally accommodated in the adapter extends into the barrel and is provided with a third roller. The first, second and third rollers clamp the cable together. The toggle penetrating the adapter is coupled with the control member. In an operation to clean a jammed pipeline, the toggle is shifted along a circumference direction of the adapter for changes of spatial positions of the third roller relative to the first and second rollers and fast movement of the cable forward or backward controllably.

5 Claims, 6 Drawing Sheets

CABLE CONTROL DEVICE FOR PIPELINE CLEANER

BACKGROUND OF THE INVENTION

1. Field of the Invention

The present invention relates to a cable control device for a pipeline cleaner and, more particularly, to a device with which a cable is driven to move forward or backward controllably.

2. Description of the Related Art

A cleaning device for cleaning conduits as disclosed in the European Patent EP 2277634 B1 includes three rollers that are arranged on a circumference of a spring shaft. The spring shaft is driven to move forward or backward controllably by an adjusting knob which regulates spatial positions of one roller relative to other two rollers. However, the cleaning device is complicated in structure, and the adjusting knob is operated inconveniently. When the adjusting knob is operated by a user for cleaning a conduit, the user has to rotate the adjusting knob by one hand but suspends the cleaning operation first or keeps the cleaning operation by the other hand only.

A cleaning device for cleaning pipelines as disclosed in the European Patent EP 3059022 includes a handle with which spatial positions of one roller relative to the other two rollers can be adjusted such that the spring shaft is driven to move forward or backward controllably. However, the operation of the handle is not ergonomic and likely to cause misoperation by an operator.

BRIEF SUMMARY OF THE INVENTION

Thus, an objective of the present invention is to provide a cable control device for a pipeline cleaner to improve the aforementioned problems. The cable control device of the present invention is simplified structurally, user-friendly, and assembled conveniently.

To achieve this and other objectives, a cable control device for a pipeline cleaner of a first embodiment of the present invention includes a barrel, a control member and a toggle. The pipeline cleaner includes a cable drum, a support tube joining at a front end of the cable drum, and a cable partially received in the cable drum. The barrel is mounted at a front end of the support tube and includes an upper body and a lower body. The upper body includes an outside surface provided with an adapter thereon. The adapter has a perforation interiorly and is provided with spaced first and second slots in the adapter and in communication with the perforation. The lower body is combined with the upper body and accommodates first and second rollers interiorly. The control member is rotationally accommodated in the perforation of the adapter and includes a bottom extending into the upper body. A third roller is mounted on the bottom of the control member. The toggle penetrates the adapter via either the first slot or the second slot optionally and is coupled with the control member for actuation of the control member and the toggle together. The cable extends through a region encircled with the first, second, third rollers and can be clamped or released by the first, second and third rollers. A width of each of the first and second slots along a circumference of the adapter is greater than a diameter of the toggle. The toggle can be shifted in the first slot or the second slot along a circumference direction of the adapter for changes of spatial positions of the third roller relative to the first and second rollers and for movement of the cable forward or backward controllably.

In a preferred form, a top lid is provided on an upper end of the adapter, and at least one washer is installed in the adapter between the control member and the top lid to elastically press the control member.

Furthermore, a cable control device for a pipeline cleaner of a second embodiment of the present invention includes a barrel, a control member and a toggle. The barrel is mounted in the front end of the support tube and includes an upper portion and a lower portion. The lower portion accommodates first and second rollers interiorly, and the upper portion is provided with a adapter thereon. The adapter has a perforation interiorly and is provided with spaced first and second slots in the adapter and in communication with the perforation. The control member is rotationally accommodated in the perforation of the adapter and includes a bottom extending into the upper portion. A third roller is mounted on the bottom of the control member. The toggle penetrates the adapter via either the first slot or the second slot optionally and is coupled with the control member for actuation of the control member and the toggle together.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
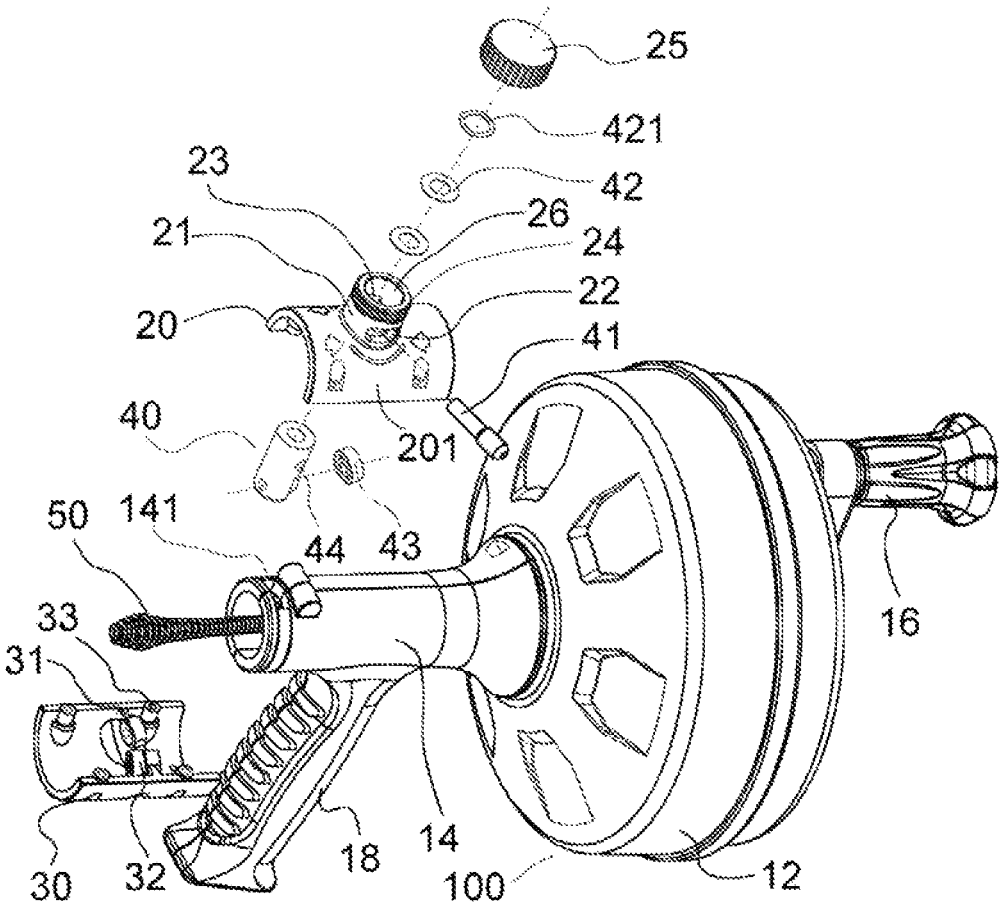
FIG. 1 is an exploded, perspective view of a pipeline cleaner including a cable control device of a first embodiment of the present invention.

A pipeline cleaner 100 including a cable control device 10 of a first embodiment of the present invention is shown in FIGS. 1 through 4 of the drawings. The pipeline cleaner 100 further includes a cable drum 12, a support tube 14 joining at a front end of the cable drum 12, and a cable 50 partially received in the cable drum 12. The cable drum 12 is provided with a crank arm 16 on a rear side thereof. A handle 18 is provided on a lower side of the support tube 14 and adapted to be held by an operator. The cable 50 extends through the support tube 14 and outwardly beyond a front end 141 of the support tube 14.

Figure 7:
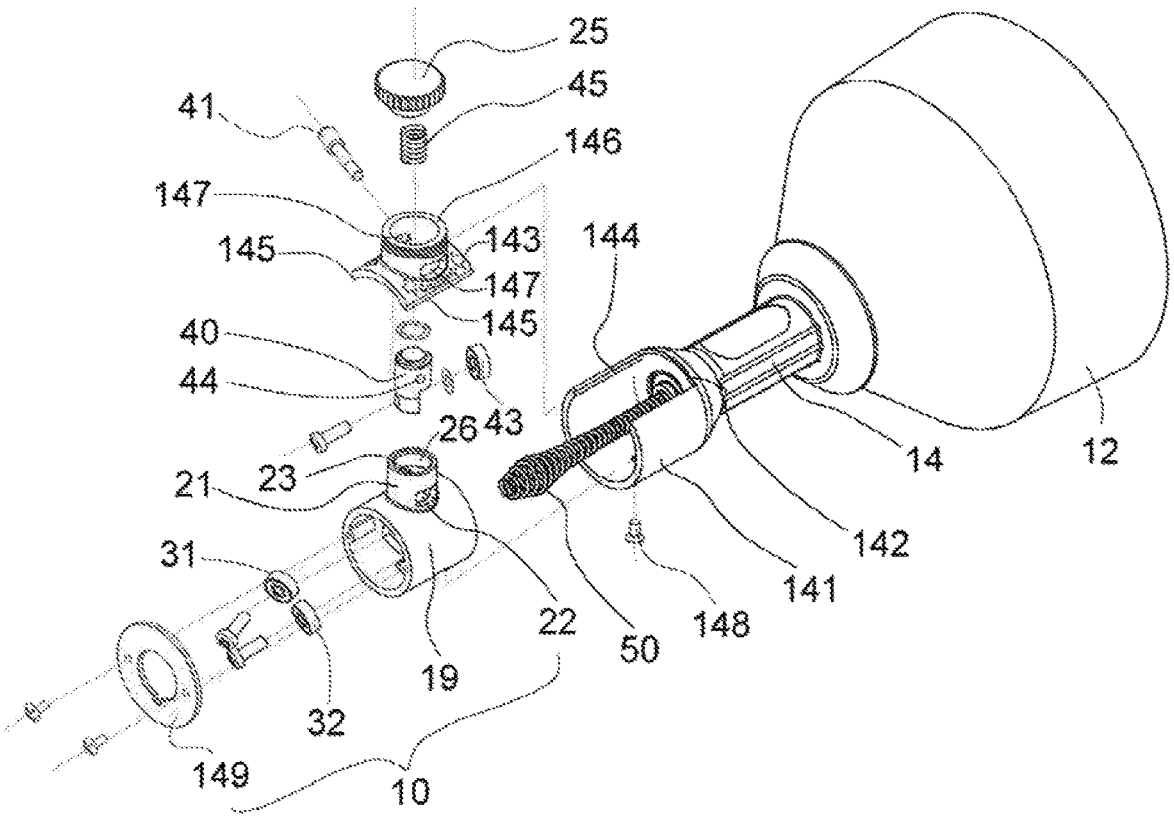
FIG. 7 is an exploded view illustrating a cable control device of a second embodiment the present invention installed at a front end of a support tube of the pipeline cleaner.

The cable control device 10 is mounted at the front end 141 of the support tube 14 and includes a barrel 19, a control member 40 and a toggle 41. In this embodiment, the barrel 19 consists of an upper body 20 and a lower body 30. In another embodiment, the barrel 19 is molded integrally, as shown in FIG. 7. The upper body 20, which is a shell body with a semi-circular profile, includes an outside surface 201 provided with a raised adapter 21 thereon. The adapter 21 has a perforation 26 interiorly and threads 24 exteriorly to which a top lid 25 is screwed. The adapter 21 is provided with one or two slots therein. In this embodiment, first and second slots 22 and 23, both of which are spaced and opposite to each other along the circumference of the adapter 21 and interconnect with the perforation 26, are opened in the adapter 21. The lower body 30, which is a shell body with a semi-circular profile, has a plurality of connecting holes 33 to be penetrated by connectors (for example, screws not shown in figures), so that the barrel 19 is constituted after combination of the lower body 30 and the upper body 20. The lower body 30 is provided with a first roller 31 and a second roller 32 interiorly.

The control member 40, which is a cylindrical body in this embodiment, is rotationally accommodated in the perforation 26 of the adapter 21. A washer 42 and a dish-shaped washer 421, both of which are installed in the adapter 21 between the top of the control member 40 and the top lid 25, are abutted and compressed by the top lid 25 that is being rotated such that a force applied on the control member 40 by the washers 42, 421 is adjusted. Each of the washer 42 and the dish-shaped washer 421 can be replaced with another elastic component. A third roller 43 is mounted on a bottom of the control member 40 which extends into the upper body 20, and at least one mounting hole 44 is formed in the control member 40 and aligned with one of the first and second slots 22 and 23.

Figure 2:
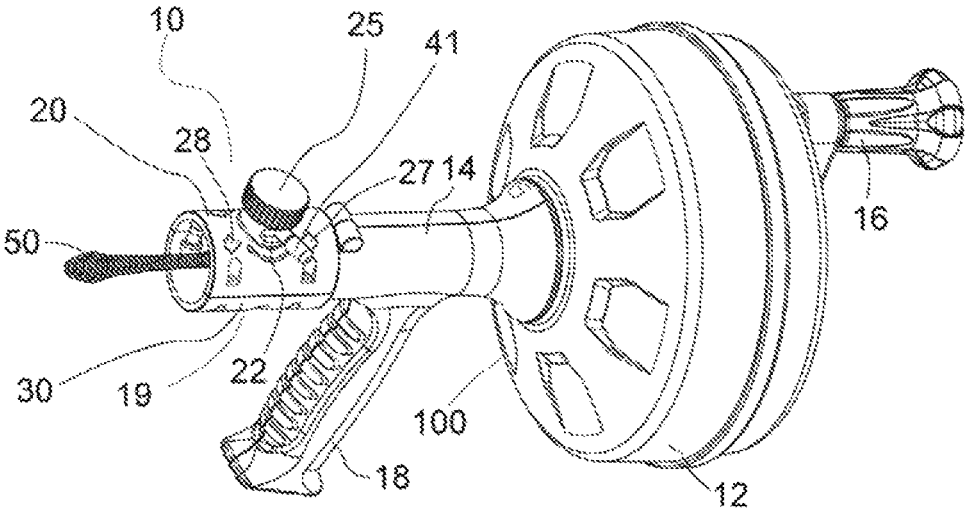
FIG. 2 is a perspective view which illustrates the pipeline cleaner in FIG. 1 assembled.
Figure 3:
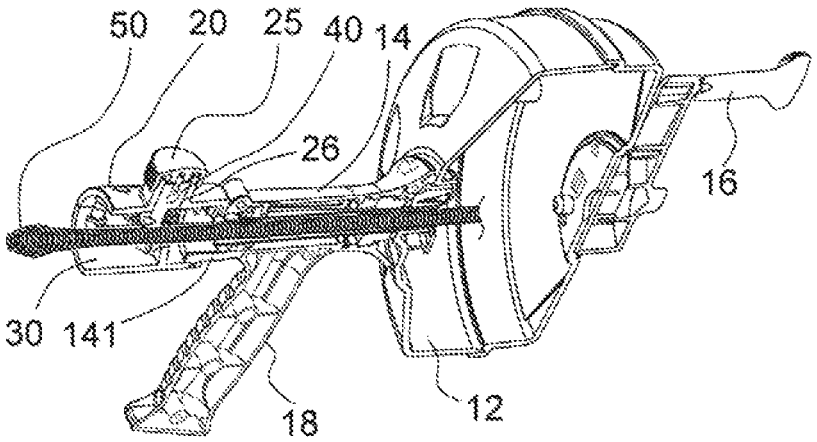
FIG. 3 is a partial, cross-sectional schematic view of the pipeline cleaner in FIG. 2.
Figure 4:
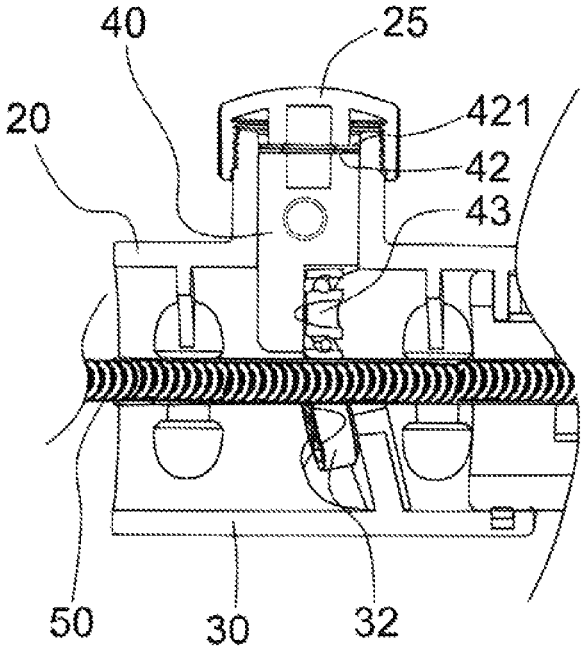
FIG. 4 is a partial schematic view of the pipeline cleaner in FIG. 3.

The toggle 41, which penetrates the adapter 21 via either the first slot 22 or the second slot 23 optionally, is engaged in the mounting hole 44 of the control member 40, so that both the control member 40 and the toggle 41 can be actuated together. A width of each of the first and second slots 22 and 23 along the circumference of the adapter 21 is greater than the diameter of the toggle 41. Accordingly, the toggle 41 driven to move around the adapter 21 circumferentially by an operator is shifted between two ends of the first slot 22 or the second slot 23 (as shown in FIG. 2, the toggle 41 is shifted to the right-hand side end of the first slot 22). The toggle 41 can be inserted into each of the first and second slots 22 and 23 in the adapter 21 by a user conveniently according to his/her operation habit of using the right or left hand. However, the case that a single slot opened in the adapter 21 and inserted by the toggle 41 is acceptable.

Figure 5:
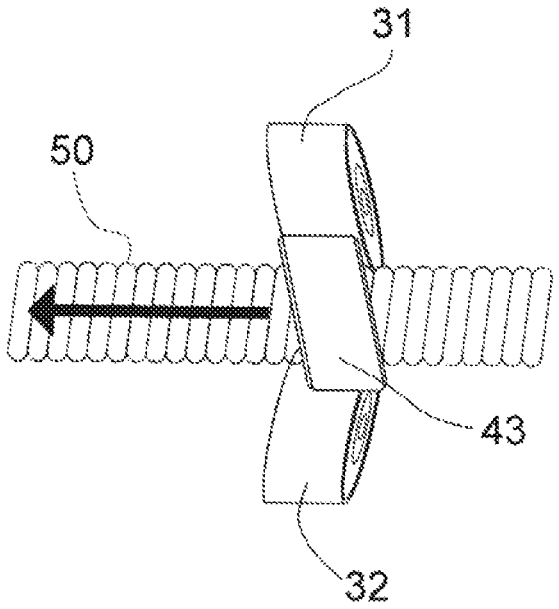
FIG. 5 is a schematic view which illustrates a cable moveable forward.

After the cable control device 10 of the present invention is installed at the front end 141 of the support tube 14, the layout of the first and second rollers 31, 32 and the third roller 43 mounted inside the barrel 19 is presented as a triangle approximately and the cable 50 extends through the three rollers 31, 32, 43 (FIG. 5). With the control member 40 abutted by the top lid 25 under control of an operator, the cable 50 is clamped by the three rollers 31, 32, 43 and moved forward or backward controllably.

Figure 6:
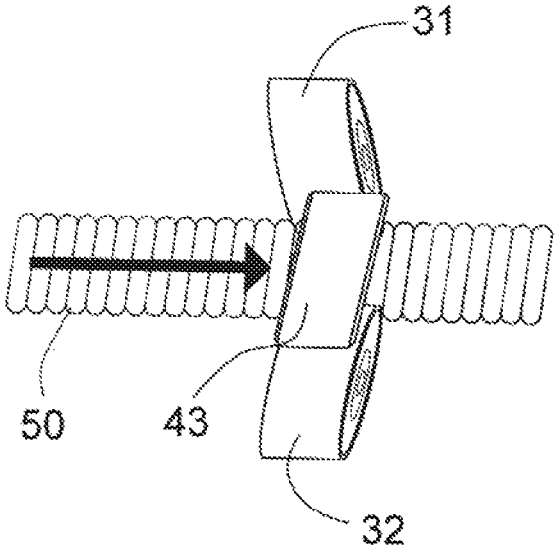
FIG. 6 is a schematic view similar to FIG. 5, illustrating a cable moveable backward due to a movement of the third roller in FIG. 5.

A user operating the pipeline cleaner 100 grips the handle 18 by one hand, rotating the crank arm 16 by the other hand and driving the cable 50 clamped by the three rollers 31, 32, 43 to move forward or backward into a drain to be cleaned. When the toggle 41 is shifted to the right-hand side end of the first slot 22 (the forward arrow 27 in FIG. 2), the third roller 43 is driven to arrive at the position in FIG. 5 by the rotated control member 40 such that the cable 50 can be moved forward controllably. On the other hand, when the toggle 41 is shifted to the left-hand side end of the first slot 22 (the backward arrow 28 in FIG. 2), the third roller 43 is driven to arrive at the position in FIG. 6 by the rotated control member 40 such that the cable 50 can be moved backward controllably.

The mechanism of changing spatial positions of one roller relative to the other two rollers for controllable movement of the spring shaft forward or backward is a prior art. However, the cable control device 10 of the present invention is simplified in structure and user-friendly in contrast to the prior art. Specifically, the cable 50 is driven to move forward or backward controllably by a user who can use his/hand gripping the handle 18 to flip the toggle 41. Accordingly, a user flipping the toggle 41 needs not to stop rotating the crank arm 16 temporarily or to operate the pipeline cleaner 100 by the other hand only. In particular, when a pipeline is clogged seriously or the cable 50 jammed in a pipeline needs to be moved back and forth for a period of time, the cable 50 can be moved back and forth alternatively by user's fingers flipping the toggle 41 easily.

Figure 8:
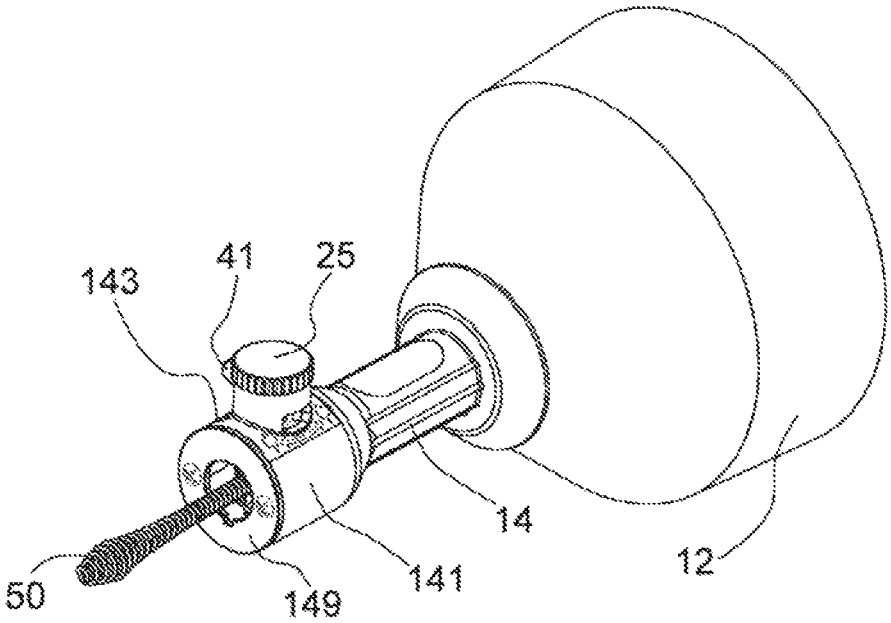
FIG. 8 is a schematic view which illustrates the cable control device in FIG. 7 assembled.

FIGS. 7 and 8 illustrate a cable control device 10 of a second embodiment of the present invention in which the components identical to those of the first embodiment are marked with the same numbers. In the second embodiment, the barrel 19 is molded integrally, both the first roller 31 and the second roller 32 are mounted in a lower portion of the barrel 19 (corresponding to the lower body 30 in FIG. 1), and both the control member 40 and the third roller 43 are installed in an upper portion of the barrel 19 (corresponding to the upper body 20 in FIG. 1). The adapter 21 extruding upward from the top of the barrel 19 has a perforation 26 interiorly, and a top lid 25 is provided on an upper end of the adapter 21. A spring 45 is mounted in the adapter 21 and located between the top of the control member 40 and the top lid 25, so that a force applied on the control member 40 by the spring 45 can be adjusted through the operation of the top lid 25. The first and second slots 22 and 23 are provided in the adapter 21 and opposite to each other in the circumference direction of the adapter 21. In the second embodiment, the front end 141 of the support tube 14 has an expanded outer diameter for accommodation of the barrel 19 and is provided with a notch 142 at an upper portion thereof on which a cover body 143 is covered. Recesses 144 formed in both side edges of the notch 142 are securely engaged with flanges 145 at two sides of the cover body 143, respectively. The cover body 143 includes an exterior barrel 146 formed at a top end surface thereof in which the adapter 21 is accommodated, and the exterior barrel 146 has two slotted holes 147 corresponding to the first and second slots 22 and 23 of the adapter 21. One of the first and second slots 22 and 23 is penetrated by the toggle 41 via a corresponding slotted hole 147 optionally, and the toggle 41 penetrating the exterior barrel 146 as well as the adapter 21 is fastened in the mounting hole 44 of the control member 40. After the barrel 19 is accommodated in the front end 141 of the support tube 14 during assembling, the barrel 19 is fixed by a screw 148 penetrating the bottom of the front end 141 and is covered by a baffle 149 fastened at a front end surface of the front end 141. Moreover, the top lid 25 is rotationally screwed onto the top of the exterior barrel 146. Accordingly, with the cable 50 clamped by the first and second rollers 31 and 32 and the third roller 43, the toggle 41 is easily shifted and flipped along the circumference of the adapter 21 by an operator for changes of spatial positions of the third roller 43 relative to the first and second rollers 31 and 32 and for controllable forward or backward movements of the cable 50.

The scope of the invention is to be indicated by the appended claims, rather than by the foregoing description, and all changes which come within the meaning and range of equivalency of the claims are intended to be embraced therein.

The invention claimed is:

1. A cable control device for a pipeline cleaner, with the pipeline cleaner including a cable drum, a support tube joining at a front end of the cable drum, and a cable partially received in the cable drum, with the cable control device comprising:

a barrel mounted at a front end of the support tube and including an upper body and a lower body, with the upper body including an outside surface provided with an adapter thereon, with the adapter having a perforation interiorly and provided with spaced first and second slots in the adapter and in communication with the perforation, with the lower body combined with the upper body and accommodating first and second rollers interiorly;

a control member rotationally accommodated in the perforation of the adapter and including a bottom extending into the upper body, with a third roller mounted on the bottom of the control member; and a toggle penetrating the adapter via either the first slot or the second slot optionally and coupled with the control member for actuation of the control member and the toggle together;

wherein the cable extends through a region encircled with the first, second and third rollers and can be clamped or released by the first, second and third rollers, wherein a width of each of the first and second slots along a circumference of the adapter is greater than a diameter of the toggle, wherein the toggle in one of the first and second slots can be shifted along the circumference of the adapter for changes of spatial positions of the third roller relative to the first and second rollers and for movement of the cable forward or backward controllably.

2. The cable control device according to claim 1, wherein a top lid is provided on an upper end of the adapter, and at least one washer is installed in the adapter between the control member and the top lid to elastically press the control member.

3. A cable control device for a pipeline cleaner, with the pipeline cleaner including a cable drum, a support tube joining at a front end of the cable drum, and a cable partially received in the cable drum, with the cable control device comprising:

an barrel mounted in a front end of the support tube and including an upper portion and a lower portion, with the lower portion accommodating first and second rollers interiorly, with the upper portion of the barrel provided with an adapter thereon, with the adapter having a perforation interiorly and provided with spaced first and second slots in the adapter and in communication with the perforation;

a control member rotationally accommodated in the perforation of the adapter and including a bottom extending into the upper portion, with a third roller mounted on the bottom of the control member; and a toggle penetrating the adapter via either the first slot or the second slot optionally and coupled with the control member for actuation of the control member and the toggle together;

wherein the cable extends through a region encircled with the first, second and third rollers and can be clamped or released by the first, second and third rollers, wherein a width of each of the first and second slots along a circumference of the adapter is greater than a diameter of the toggle, wherein the toggle in one of the first and second slots can be shifted along the circumference of the adapter for changes of spatial positions of the third roller relative to the first and second rollers and for movement of the cable forward or backward controllably.

4. The cable control device according to claim 3, wherein the front end of the support tube has an expanded outer diameter for accommodation of the barrel and is provided with a notch at an upper portion thereof on which a cover body is covered, with the cover body including an exterior barrel at a top end surface thereof in which the adapter is accommodated, with the exterior barrel having two slotted holes corresponding to the first and second slots of the adapter, wherein the toggle penetrates one of the first and second slots via a corresponding slotted hole and is coupled with the control member.

5. The cable control device according to claim 4, wherein a top lid is provided on a top of the exterior barrel, and a spring is installed in the adapter between the control member and the top lid to elastically press the control member.

* * * * *